United States Patent [19]

Nakako et al.

[11] 4,185,395

[45] Jan. 29, 1980

[54] METHOD FOR THERMAL DEHYDRATION OF BROWN COAL

[75] Inventors: Yukio Nakako, Takarazuka; Kenjiro Motonaga, Kobe; Junichiro Nada, Kobe; Toshio Ohzawa, Kobe; Shizuo Yokota, Nishinomiya; Haruo Kakunai, Akashi, all of Japan

[73] Assignee: Kobe Steel, Limited, Kobe, Japan

[21] Appl. No.: 885,125

[22] Filed: Mar. 10, 1978

[30] Foreign Application Priority Data

Mar. 12, 1977 [JP] Japan ..... 52/27214
Mar. 12, 1977 [JP] Japan ..... 52/27215
Apr. 8, 1977 [JP] Japan ..... 52/40541

[51] Int. Cl.[2] ..... F26B 7/00
[52] U.S. Cl. ..... 34/12; 159/47 R
[58] Field of Search ..... 34/12; 159/46, 47 R

[56] References Cited

U.S. PATENT DOCUMENTS 2,830,769 4/1958 Work ..... 154/47 R

*Primary Examiner*—John J. Camby
*Attorney, Agent, or Firm*—Oblon, Fisher, Spivak, McClelland & Maier

[57] ABSTRACT

A method is disclosed for thermal dehydration of brown coal, by which an excellent heat recovery can be accomplished. The method includes the steps of admixing raw brown coal with a solvent to prepare a slurry, preheating the slurry in a heat exchanger, heating the same at 100° to 300° C., passing it through a gas-liquid separator to separate it into a steam-containing vapor and a dehydrated slurry and recoverying the dehydrated slurry while the steam-containing vapor is recycled to the heat exchanger so as to be utilized as a heating medium for preheating the slurry.

12 Claims, 2 Drawing Figures

METHOD FOR THERMAL DEHYDRATION OF BROWN COAL

BACKGROUND OF THE INVENTION

1. Field of the Invention

This invention relates to a method for thermal dehydration of brown coal, by which an excellent heat recovery can be accomplished.

2. Brief Description of the Prior Art

Coal has been generally used as fuels, or have been hydrogenated and fractionated into fractions suitable for various applications. In the case of certain types of coal with high moisture contents, particularly certain brown coal which normally contain about 60 percent of moisture, thermal efficiencies are detrimentally low if they are directly subjected to hydrogenation or liquefaction or used as fuels. It is, thus, necessary that such coals be dehydrated beforehand to a moisture content of about 10 percent. Heretofore, a flash drying method has been mostly employed to dry the coals. This method is such that brown coal, for example, is finely divided and exposed to a hot gas stream to evaporate the water.

In this prior art method, however, the amount of heat required to heat the gas stream to a temperature necessary for the dehydration of brown coal is as high as about 25 percent, in terms of the heat value of brown coal based on the amount of brown coal that is treated. Since this means that a considerable additional amount of brown coal is inevitably consumed, the method is quite disadvantageous costwise. Generally, in this type of drying method, the hot gas stream is made by the combustion of an air and fuel mixtures. In this case, the excess oxygen in the hot gas stream oxidizes the brown coal grains to produce an oxide film on the surface. When the slurry is subjected to hydrogenation or liquefaction, this oxide film considerably interferes with the reaction. Furthermore, because the temperature of the hot gas stream is as high as about 900° C., the volatile components in the brown coal are partially decomposed, gasified and carried away by the hot gas stream, thus resulting in reduced products yielded in the reaction.

SUMMARY OF THE INVENTION

This invention has been made to overcome the above-mentioned disadvantages. The object of this invention is, therefore, to provide a method for effective and economic dehydration of brown coal for the purpose of using it as a raw material of slurry fuel composed of fine coal and hydrocarbons or as a feed coal for a coal hydrogenation process.

The above-noted object is accomplished by the instant invention in several modes or embodiments.

In a first aspect, this invention includes admixing raw brown coal with liquid hydrocarbons to prepare a slurry, preheating the slurry in a heat exchanger, heating the same to a temperature in the range of 100° to 300° C., preferably between 110° and 250° C., passing the heated slurry to a gas-liquid separator to fractionate it into a steam-containing vapor and a dehydrated slurry and recovering the same slurry while the steam-containing vapor is recycled to the heat exchanger as a heating medium for preheating the slurry.

In a second aspect, the method of this invention includes, in the process described above with reference to the first aspect, passing the brown coal hydrocarbons slurry through a first or downstream heat exchanger to preheat the slurry and, then, through a second or upstream heat exchanger to further preheat the same, heating the preheated slurry at a temperature in the range of 100° to 300° C., preferably at 110°-250° C., passing the heated slurry to a gas-liquid separator to separate it into a steam-containing vapor and a dehydrated slurry and recovering the dehydrated slurry while the steam-containing vapor is recycled to the second heat-exchanger to preheat the slurry.

In a third aspect, the method of this invention includes, in the process described above with reference to the second aspect, recycling the steam-containing vapor fed back to the second heat exchanger and further to the first heat exchanger.

In a fourth aspect, the method of this invention is such that, in the second or third aspect described above, the steam-containing vapor recovered in the gas-liquid separator is passed through a hot-water scrubber and recycled to the second heat exchanger for preheating the slurry while the condensate from the heat exchanger just mentioned is recycled to the hot-water scrubber for use as a washing medium for the steam-containing vapor.

In a fifth aspect, the method of this invention includes, in the fourth aspect, a portion of the condensate being employed as the washing medium and being recycled to the first heat exchanger for preheating the slurry.

In a sixth aspect, the method of this invention is such that, in any of the first to fifth aspects, low boiling point hydrocarbons in the steam containing vapor are recovered and reused for the preparation of the slurry.

In a seventh aspect, the method of this invention is such that, in any of the first to sixth aspects, the dehydrated slurry recovered in the gas-liquid separator is reheated at elevated pressure for use in a coal hydrogenation process.

In a eighth aspect, the method of this invention is such that, in the seventh aspect, liquid hydrocarbons comprise low and high boiling points hydrocarbons and the low boiling point hydrocarbons are recovered from the steam containing vapor and high boiling point hydrocarbons are recovered through a distillation step of the coal hydrogenation process.

In a ninth aspect, the method of this invention is such that, in any of the first to eighth aspects, the raw brown coal and the liquid hydrocarbons are admixed and adjusted so that the brown coal-hydrocarbons slurry has a viscosity of not more than 200 cps. at a temperature not exceeding 150° C.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein like reference characters designate like or corresponding parts throughout the several views, and wherein.

DETAILED DESCRIPTION OF THE PREFERRED EMBODIMENTS

Figure 1:
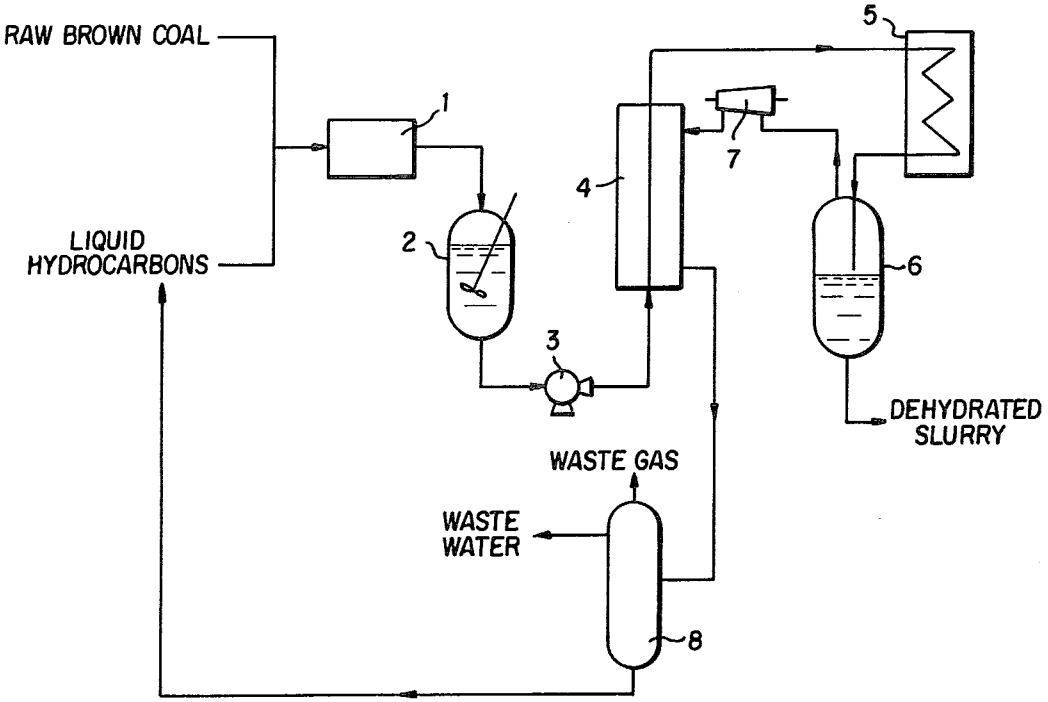
FIGS. 1 and 2 are flow charts illustrating preferred embodiments of this invention.

The method of this invention will hereinafter be described by reference to the flow chart of FIG. 1. In the illustrated embodiment, raw brown coal and suitable liquid hydrocarbons are throughly mixed together by an appropriate mixing member (1) such as a ball mill and stirred in a slurry tank (2) to prepare a coal-hydrocarbons slurry. By means of a slurry pump (3), the slurry is fed to a heat exchanger (4), where the slurry is preheated by heat-exchange with the vapor recycled from a gas-liquid separator to be described hereinafter. The preheated slurry is heated by a heating means (5) to a temperature in the range of about 100° to 300° C., preferably between 110° to 250° C., and then passed through the gas-liquid separator (6) at a pressure sufficiently high to permit adequate evaporation of the moisture at such temperature, whereby the slurry is separated into a vaporous fraction containing steam and the vapors of light hydrocarbons on the one hand and a dehydrated slurry on the other hand. The dehydrated slurry is recovered from the bottom of the gas-liquid separator (6). The dehydrated slurry obtained in the above-noted manner can be used either as a feed slurry for a hydrogenation process or as a slurry fuel. On the other hand, the steam-containing vapor withdrawn from the top of the gas-liquid separator (6) is compressed by a pressurizer (7) such as a booster to attain a condensation temperature capable of heat exchange with the slurry to be heated in the heat exchanger (4). Thus, the vapor is circulated through the heat exchanger (4) to preheat the slurry through a heat-exchanger step. The vapor is cooled and condensed by this heat-exchange in heat exchanger step (4) and this condensate is fed to an oil-water separator (8) where it is decompressed and separated into waste gas, waste water and a low-boiling point hydrocarbon fraction. The low-boiling point hydrocarbon fraction is reused for the preparation of the slurry.

The liquid hydrocarbons to be admixed with raw brown coal may be any hydrocarbons that are able to provide a slurry of suitable viscosity throughout the entire thermal dehydration process. Thus, there may be mentioned aromatic hydrocarbons such as benzene, toluene, xylene, etc.; paraffinic hydrocarbons, naphthenic hydrocarbons, anthracene oil, creosote oil, light oil, etc. For the purpose of preparing a slurry for use in a hydrogenation process, high-boiling point hydrocarbons suited for the hydrogenation reaction (e.g. hydrocarbons having boiling point between 250° to 420° C.) may be employed advantageously. If the use of such high-boiling point hydrocarbons alone tends to result in a slurry with an excessively high viscosity, such may be blended with an appropriate proportion of one or more lower-boiling point hydrocarbons (e.g. hydrocarbons having a boiling point between 110° and 220° C.).

While there is no particular limit to the mixing ratio of raw brown coal to liquid hydrocarbons, these materials are admixed in such proportions that the resultant slurry will have a viscosity of not more than 200 cps. at a temperature below 150° C., preferably a viscosity of about 5 to 10 cps. at that temperature. By way of illustration, a suitable slurry can be obtained by admixing raw brown coal, high-boiling point hydrocarbons and low-boiling point hydrocarbons in a ratio of 10:8–12:0~8 by weight.

For the purpose of preparing a slurry for a coal hydrogenation process, a necessary catalyst may be previously added to the slurry.

The raw brown coal and liquid hydrocarbons are evenly admixed by means of a crusher-mixer such as a ball-mill and the mixture is sent to the slurry tank for the preparation of a slurry. This slurrying operation must be carried out at temperatures conducive to viscosities permitting stable transport of the slurry. If this temperature range is exceeded, cavitation takes place in the slurry pump due to vaporization of the light hydrocarbons. Therefore, the slurrying operation is normally carried out at a temperature below 100° C., preferably from room temperature to about 60° C., depending on the type of liquid hydrocarbons employed.

As mentioned hereinbefore, the slurried coal-hydrocarbons mixture is preheated as it is passed through the heat exchanger and, subsequently heated to a temperature exceeding 100° C. If this heating temperature is excessively high, carbon dioxide and hydrocarbons will be liberated and evaporated from the brown coal to cause significant reductions in the rate of heat-exchange in the heat exchanger with steam containing vapor recovered from the gas-liquid separator, as will be described in detail hereinafter. Thus, if the heating temperature is over 300° C., the gases from the brown coal will account for about 1.5 percent (by volume) of the total vapor and, consequently, the coefficient of heat transfer in the heat exchanger will drop to about 80 percent. Therefore, the upper limit of temperature used for heating the slurry should be 300° C., the preferred range being from 110° to 250° C. The slurry thus heated is subjected to gas-liquid separation at a pressure conducive to an adequate evaporation of moisture in that temperature range and is thereby separated into a vapor (i.e. steam including the vapors of low-boiling point hydrocarbons) and a dehydrated slurry.

The separated vapor is recovered and recycled to the heat exchanger as a heating medium for preheating the slurry which is to be heat-treated. To ensure an efficient heat-exchange between the slurry and the vapor, the vapor is preferably compressed until it has attained a temperature permitting an adequate heat-exchange before it is guided into the heat exchanger. In this process of heat-exchange, the vapor is condensed as it undergoes heat-exchange with the slurry and the resultant condensate undergoes a further heat-exchange with the slurry at a lower temperature downstream before it is finally withdrawn from the bottom of the heat exchanger.

By the utilization of the waste heat of steam, the temperature of the slurry is increased to the boiling point of the water the slurry contains under the operating conditions. The result is that substantially all of the moisture is evaporated so that almost all of the total thermal energy requirement of the thermal dehydration process is reclaimed.

The brown coal in the dehydrated slurry obtained by the above-mentioned gas-liquid separation has been sufficiently dried to a moisture content of about 10 percent, and can be advantageously put to use, either as it is or after an appropriate pretreatment suitable for any other intended application.

Particularly when the dehydrated slurry is to be employed as a feed slurry for a hydrogenation reaction, it is further heated at an elevated pressure to obtain a pressurized high-temperature slurry suitable for use in subsequent hydrogenation. Thus, for example, the pressure may be 150 atms. and the temperature may be about 400° C. or higher.

Figure 2:
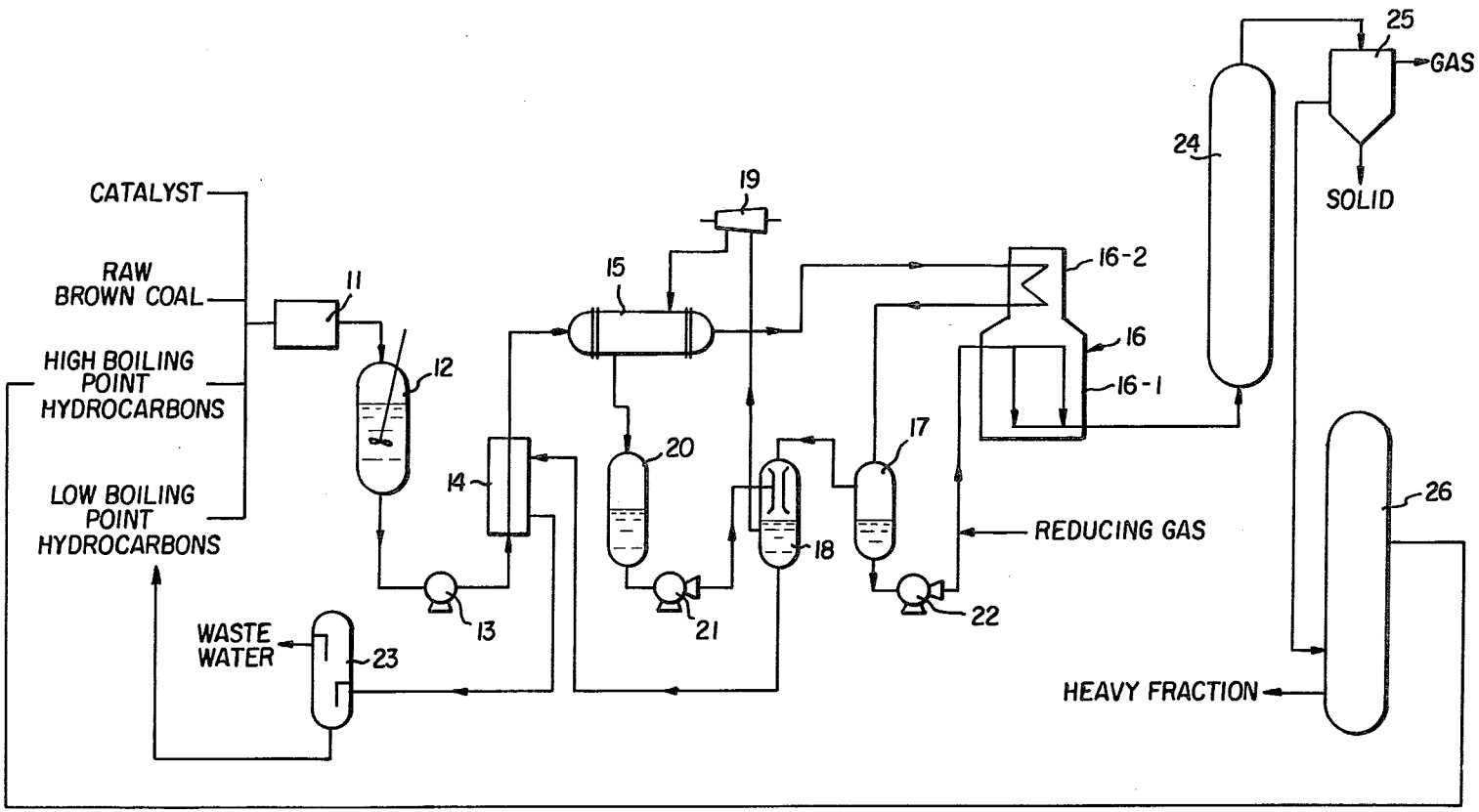

In a modified method according to this invention, a couple of heat exchangers may be installed in series, with the steam-containing vapor separated in a gas-liquid separator being passed to a second or downstream heat exchanger (if necessary, the vapor is heated before being introduced into said heat exchanger) and, then, fed to a first or upstream heat exchanger so as to preheat the slurry in two stages. In a preferred embodiment, which is illustrated in FIG. 2, a hot-water scrubber (18) is interposed between the gas-liquid separator and a second heat exchanger so that the steam-containing vapor is passed through the scrubber (18) to remove the mist (i.e. liquid oil and solid particles accompanied with it) before it is fed to the second heat exchanger. Thus, the steam-containing vapor emerging from the top of the gas-liquid separator (17) contains a certain amount of mist (i.e. liquid oil and solid particles accompanied with it) and, consequently, if the vapor is directly fed to the second heat exchanger, the mist will collect on the heat transfer surfaces to reduce the coefficient of heat-exchange, thus causing a considerable reduction in heat-exchange efficiency. Moreover, if a pressurizer such as a booster is utilized, the function of the booster is also adversely affected. Therefore, the vapor from the gas-liquid separator (17) is first passed through the hot-water scrubber (18) to remove the mist well and, subsequently compressed by the booster (19) to attain a temperature which is conducive to an efficient heat-exchange with the slurry in the second heat exchanger (15). The vapor at this elevated temperature is then fed to the above-noted heat exchanger (15) where it is subjected to heat-exchange with the slurry so as to preheat the latter. During its passage through the second heat exchanger (15), the vapor is cooled to form a condensate which is stored in a condensate reservoir (20), from which it is transferred by a hot water pump (21) to the hot water scrubber (18) for use as a washing medium. The surplus hot water is recycled to the first heat exchanger (14) for use as a slurry-preheating medium and then sent to an oil-water separator (23) where it is decompressed and separated into a waste gas, waste water, low-boiling point hydrocarbons and other fractions. The low-boiling point hydrocarbons fraction is reused for the preparation of the slurry.

The following examples are intended to further describe this invention.

EXAMPLE 1

By the process depicted in FIG. 1, a desired dehydrated brown coal slurry was prepared under the following conditions.

Thus, 1000 kg of raw brown coal (moisture content: 60%), 800 kg of a hydrocarbon fraction having a boiling point of 250°–420° C. and 150 kg hydrocarbon fraction having a boiling point of 110°–220° C. were mixed together and the mixture was milled well in the ball mill (1) and transferred to the slurry tank (2) where it was slurried at 40° C. This slurry was fed by slurry pump (3) to heat exchanger (4) at a pressure of about 6.2 atms. and preheated by heat-exchange with the vapor as described hereinafter. After the moisture was thus evaporated by heat-exchange, the slurry was passed through heating furnace (5) at a given linear velocity, whereby it was heated to about 150° C. The heated slurry was fed to gas-liquid separator (6) where it was separated into a vapor and a dehydrated slurry. The moisture content of particulate brown coal in this dehydrated slurry was about 10 percent. The vapor separated as above (which was predominantly composed of water vapor with low-boiling point hydrocarbons accounting for the remainder) was pressurized to about 7 atms. by the booster (7) and the resultant high temperature vapour was fed to the heat exchanger (4) for heat-exchange with the slurry. The slurry was heated by this heat-exchange, the waste heat of the vapor being thus reclaimed. The thermal energy thus recovered amounted to about 80% of the total heat requirement of the dehydration process, which means that the same amount of heat was saved.

The exhaust vapor after the heat-exchange (which was about 50° C.) was fed to the oil-water separator (8) where a low-boiling point hydrocarbon fraction was recovered from the vapor for reuse.

EXAMPLE 2

By the process depicted in FIG. 2, a coal slurry for hydrogenation purposes was produced under the following conditions.

Thus, 1000 kg of raw brown coal (moisture content: 60%), 800 kg of hydrocarbons having boiling point of 250°–420° C., 150 kg of hydrocarbons having boiling point of 110°–220° C. and, as a catalyst, 1.5% (wt.% based on the dry weight of brown coal) of iron oxide were mixed together, milled well in a ball mill (11) and transferred to a slurry tank (12) where it was slurried at 40° C. This slurry was transported by slurry pump (13) to the first heat exchanger (14) at 6.2 atms. In this heat exchanger, the slurry was preheated by heat-exchange with the hot water recycled from a hot-water scrubber (18) as described hereinafter. The preheated slurry was fed to the second heat exchanger (15) where it was subjected to heat-exchange with the vapor demisted by the hot-water scrubber (18), whereby the slurry was further preheated to a higher temperature. This preheated slurry was fed to the top of heating furnace (16-2) and was thereby preheated as it flowed down at a given linear velocity, whereby the slurry was heated to abount 150° C. This slurry was then fed to gas-liquid separator (17), which separated the slurry into a vapor and a dehydrated slurry. The moisture content of the particulate brown coal in this dehydrated slurry was about 10%. This dehydrated slurry was further transported by high-pressure slurry pump (22) to a heating furnace (16-1) at 150 atms. and heated to 420° C. By the above-noted procedure a high-temperature, high-pressure slurry was obtained. This slurry included sufficiently dehydrated particulate brown coal as well as high-boiling point hydrocarbons and catalyst in predetermined proportions, and could be directly used in a hydrogenation reaction system. Thus was formed a high temperature, high pressure slurry to which a reducing gas was introduced prior to heat treatment of the slurry in the heating furnace (16-1) was fed to a reactor (24) to subject the slurry to liquefaction or hydrogenation. Then the slurry was passed through a solid-liquid separator (25) and a distillation column (26). In the distillation column (26), the slurry was fractionated into heavy fraction as a product and high boiling point liquid hydrocarbons. The recovered high boiling point hydrocarbons were recycled to the ball mill as a medium for the preparation of slurry.

The vapor (predominantly composed of water vapor, with minor amounts of the vapor and mist of low-boiling point hydrocarbons) separated by the gas-liquid separator (17) was fed to the hot-water scrubber (18) where the mist was removed from the vapor. The demisted vapor was then boosted to about 7 atms. by pressurizer (19) and the resultant high-temperature vapor was passed through the second heat exchanger (15) where it was used to preheat the subsequent flow of slurry. The hot water condensate obtained in the heat exchanger (15) was stored in condensate reservoir (20), from which it was transported by hot-water pump (21) to the hot-water scrubber (18) where it was used as a scrubbing medium, with a portion thereof being recycled to the first heat exchanger (14) for reuse as a heating medium for preheating the slurry. The waste heat thus reclaimed in the first and second heat exchangers (14 and 15) in the forms of vapor and hot water for preheating the slurry was equivalent to about 80% of the total heat requirement of the heating process.

The hot water about 50° C.) used in the above heat-exchange was then introduced into an oil-water separator (23) where it was separated into a water vapor and a low-boiling point hydrocarbons fraction which was recovered as a medium for the preparation of slurry.

Thus, in accordance with the present invention, because raw brown coal is dehydrated as a slurry, the coal is not exposed to atmosphere and, therefore, the disadvantages of the prior art flash drying process are eliminated. Moreover, because the vapor produced in the dehydration process is utilized as a heating medium for preheating the slurry and the waste heat is thus reclaimed, the thermal energy requirement of the dehydration process is considerably reduced. That is to say, sufficiently dehydrated brown coal can be obtained in the form of a slurry with satisfactory thermal efficiency.

Obviously, many modifications and variations of the present invention are possible in light of the above teachings. It is therefore to be understood that within the scope of the appended claims, the invention may be practiced otherwise than as specifically described herein.

What is claimed is:

1. A method for thermal dehydration of brown coal in a system including mixing means, a heat exchanger, a heating member, and gas-liquid separator means which comprises:
   - admixing raw brown coal with liquid hydrocarbon in said mixing means to prepare a slurry,
   - passing the slurry through said heat exchanger to preheat the same, and directly to said heating member,
   - heating the slurry in said heating member to a temperature in the range of 100° to 300° C.,
   - subjecting the heated slurry to gas-liquid separation in said separator to fractionate said heated slurry into a steam-containing vapor and a dehydrated slurry,
   - recovering the dehydrated slurry, and
   - recycling said steam-containing vapor to said heat exchanger as a heating medium for preheating the slurry.

2. A method for thermal dehydration of brown coal as set forth in claim 1 wherein said slurry has a viscosity of not more than 200 cps. at a temperature not exceeding 150° C.

3. A method for thermal dehydration of brown coal as set forth in claim 1 wherein the heated slurry is heated to a temperature in the range of 110° to 250° C.

4. A method for thermal dehydration of brown coal in a system including mixing means, a first heat exchanger, a heating member, a second heat exchanger and a gas-liquid separator which comprises:
   - admixing raw brown coal with liquid hydrocarbons in said mixing means to prepare a slurry,
   - passing the slurry through said first heat exchanger to initially preheat the slurry and, then, through said second heat exchanger to further preheat the slurry,
   - heating the preheated slurry in said heating member to a temperature in the range of 100° to 300° C.,
   - subjecting the preheated slurry to gas-liquid separation in said separator to fractionate said heated slurry into a steam-containing vapor and a dehydrated slurry,
   - recovering the dehydrated slurry and,
   - recycling said steam-containing vapor to said second heat exchanger as a heating medium for preheating the slurry.

5. A method for thermal dehydration of brown coal as set forth in claim 4 further comprising further recycling said steam-containing vapor recycled to said second heat exchanger to said first heat exchanger as a heating medium for preheating the slurry.

6. A method for thermal dehydration of brown coal as set forth in claim 4, said system including a hot-water scrubber, further comprising passing the steam-containing vapor recovered by subjecting said heated slurry to said gas-liquid separation through said hot-water scrubber to said second heat exchanger for use as a heating medium for preheating the slurry and recycling a condensate withdrawn from said heat exchanger to said hot-water scrubber as a washing medium for demisting said steam-containing vapor.

7. A method for thermal dehydration of brown coal as set forth in claim 6 further comprising recycling a portion of said washing medium to said first heat exchanger as a heating medium for preheating the slurry.

8. A method for thermal dehydration of brown coal as set forth in claim 1 further comprising reheating the dehydrated slurry obtained by subjecting said heated slurry to said gas-liquid separation at an elevated pressure for use in a coal hydrogenation process.

9. A method for thermal dehydration of brown coal as set forth in claim 8 wherein said slurry contains a catalyst.

10. A method for thermal dehydration of brown coal as set forth in claim 8 wherein said liquid hydrocarbons comprise low boiling point hydrocarbons and high boiling point hydrocarbons.

11. A method for thermal dehydration of brown coal as set forth in claim 10 further comprising recovering said low boiling hydrocarbons from said steam-containing vapor and recovering said high boiling point hydrocarbons through distillation in said coal hydrogenation process.

12. A method for thermal dehydration of brown coal as set forth in claim 1 further comprising recovering low boiling point hydrocarbons in said steam-containing vapor and reusing said low boiling point hydrocarbons containing vapor for preparation of the slurry.

* * * * *